US007275709B2

(12) United States Patent
Weis

(10) Patent No.: US 7,275,709 B2
(45) Date of Patent: Oct. 2, 2007

(54) TURNING DEVICE

(75) Inventor: Anton Weis, Lorsch (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 300 days.

(21) Appl. No.: 10/480,645

(22) PCT Filed: Jun. 17, 2002

(86) PCT No.: PCT/DE02/02199

§ 371 (c)(1),
(2), (4) Date: Dec. 29, 2003

(87) PCT Pub. No.: WO03/002440

PCT Pub. Date: Jan. 9, 2003

(65) Prior Publication Data

US 2004/0149855 A1 Aug. 5, 2004

(30) Foreign Application Priority Data

Jun. 28, 2001 (DE) ..... 101 31 272

(51) Int. Cl.
*B65H 23/24* (2006.01)
*B65H 23/26* (2006.01)

(52) U.S. Cl. ..... 242/615.12; 242/615.21

(58) Field of Classification Search ..... 242/615.1, 242/615.12, 548, 548.4, 566, 615.2, 615.21; 226/97.1, 97.3, 196.1
See application file for complete search history.

(56) References Cited

U.S. PATENT DOCUMENTS

| | | | | |
|---|---|---|---|---|
| 2,940,752 | A * | 6/1960 | Deeken | 226/180 |
| 3,599,851 | A | 8/1971 | Hedlund | |
| 3,623,645 | A | 11/1971 | Klingler | |
| 3,809,303 | A | 5/1974 | Brunner | |
| 4,453,465 | A | 6/1984 | Heller et al. | |
| 5,100,117 | A * | 3/1992 | Hajek et al. | 270/52.08 |
| 5,316,199 | A | 5/1994 | Hansen et al. | |
| 5,464,143 | A | 11/1995 | Hansen | |
| 5,520,317 | A | 5/1996 | Eckert et al. | |
| 6,533,217 | B2 * | 3/2003 | Lind | 242/615.12 |

FOREIGN PATENT DOCUMENTS

| | | |
|---|---|---|
| CA | 2063903 | 9/1992 |
| DE | 2610957 A1 | 9/1977 |
| DE | 2920684 A1 | 11/1980 |
| DE | 3127872 | 11/1985 |
| DE | 3436870 C1 | 5/1986 |
| DE | 93 20 281.4 | 4/1994 |
| DE | 4311438 C2 | 6/1997 |
| EP | 92302607.4 | 9/1992 |
| JP | 61-132357 | 8/1986 |
| JP | 7002402 | 1/1995 |
| JP | 7101036 | 4/1995 |
| JP | 9227000 | 9/1997 |

* cited by examiner

*Primary Examiner*—John Q Nguyen
*Assistant Examiner*—Scott Haugland
(74) *Attorney, Agent, or Firm*—Jones, Tullar & Cooper, P.C.

(57) ABSTRACT

A turning device uses a turning bar for diverting a material web. The turning bar includes a sleeve with a plurality of holes and an inner chamber that is supplied with compressed air, as well as a closing body. The turning bar is supported by a frame and is able to pivot through 90°. The closing body is movable within the inner chamber in response to this pivoting movement of the turning bar. Movement of the closing body closes one of two groups of the holes, depending on the position of the turning bar. The turning bar is connected to the frame at only one end and is supplied with compressed air through a joint connecting the turning bar to the frame.

24 Claims, 4 Drawing Sheets

TURNING DEVICE

FIELD OF THE INVENTION

The present invention is directed to a turning device having a turning bar. The turning device is useable for rerouting a web of material.

BACKGROUND OF THE INVENTION

In order to be able to process webs of material which are fed from two diametrically opposed directions to a single downstream located machine, or in order to be able to feed paper webs, which are coming from the same direction, to two different machines for further processing, turning bar arrangements have been developed. The turning bars are movable between two work positions, each of which causes a rerouting of the web of material by 90°, into opposite directions.

Such a turning bar arrangement is known from DE 43 11 438 C2. This turning bar arrangement comprises a plurality of turning bars. Both longitudinal ends of each turning bar are hingedly connected with support spindles of a rack and each turning bar end can be displaced, along these support spindles. The turning bars can each assume two different work positions, in which they each extend at an angle of 45° in relation to the support spindles. The turning bars can each be transferred from one of their work positions into the other of their work positions by a pivot movement of 90° in the plane defined by the axes of the support spindles and of the turning bars. This transfer takes place through movement of the turning bars through an intermediate position, in which each of the turning bars extends perpendicularly with respect to the support spindles. To make such a transfer possible, it is necessary for each of the support spindles to be movable, coordinated with the movement of the turning bars, perpendicularly with respect to each other.

Turning bar arrangements are also known, in which the turning bars can be switched from one work position into the other work position on an axis which is parallel to the plane defined by the axes of the support spindles and of the turning bars. However, such a turning bar arrangement requires sufficient space, either above or underneath of this plane, for performing the transfer movement.

DE 29 20 684 A1 discloses a linear actuating member for pivoting a turning bar.

DE 31 27 872 C2 describes a turning bar, whose first end is seated changeably in a rack, and whose second end is displaceably seated in a guide device. Compressed air is supplied through a link, and the guide devices can be displaced by use of linear drive mechanisms and can be secured by use of clamping devices.

SUMMARY OF THE INVENTION

The object of the present invention is directed to providing a turning device with a turning bar which can be simply and dependably pivoted.

In accordance with the present invention, this object is attained by the provision of a turning device having a turning bar for rerouting a web of material. A rack supports the turning bar for pivotal movement. The turning bar has a free longitudinal end which is not connected directly to the rack and which extends, in a cantilever manner from the rack. An actuator is usable to pivot the turning bar through 90° between the two work positions. At least one fixation device is usable to secure the turning bar in its two work positions.

The actuator may be a linear actuator, particularly a pneumatic cylinder. The linear actuator may be connected with the rack and the turning bar.

An advantage which can be achieved by the use of the present invention lies, in particular, in that the mechanical structure of the turning device is simplified. A hinged connection of the second longitudinal end of the turning bar with the rack is omitted. Therefore, neither a second support spindle, nor any mechanism for controlling its movements, are necessary. Passage of a compressed air feed line through a link connecting the turning bar with the rack permits a particularly compact construction especially in the vertical direction. Moreover, it is possible to do without a flexible pipe line, which flexible line is in danger of wear or damage, for conducting the compressed air to the turning bar.

When the turning bar in accordance with the present invention is employed for rerouting webs of material of varying widths, it is desirable to be able to limit the size of the surface area of the jacket of the turning bar, from which compressed air exits to form an air cushion underneath the web of material to be rerouted, in accordance with the width of the web of material. For this purpose, at least one piston, which axially limits the compressed air-supplied interior of the turning bar, is axially displaceable inside the turning bar.

Since a free end of the turning bar is not needed for use in connecting the compressed air feed line to the turning bar, an actuating element for use in adjusting the position of the at least one piston can preferably be conducted out of the turning bar at this free end. This actuating element can have, for example, the shape of a knurled wheel or of a crank for use in turning a threaded bar which is extending through the turning bar, in the longitudinal direction of the turning bar, and whose screw thread meshes with a threaded bore in the piston.

A closing body, which is used for the selective closing of each of a group of holes in the jacket of the turning bar, is preferably embodied as a hollow cylinder. The at least one piston can be displaced within this hollow cylinder. This arrangement makes it possible to move the closing body and the at least one piston independently of each other.

If the at least one piston is arranged in the turning device at the longitudinal end of the turning bar which is connected with the link, it is necessary to conduct the compressed air, which is fed into the interior of the turning bar, through this piston. For this purpose, a section of the compressed air feed line in the interior of the turning bar, is embodied as a tube section which traverses the piston.

The rack which supports the turning bar has two stops for use in fixing the end position of the pivot movement freedom, which two stops are preferably adjustable.

Furthermore, at least one fixation device, for use in fixing the turning bar in respective end positions of the pivot movement freedom, is provided. This fixation device preferably comprises a bolt which is connected with the rack for engaging a projection of the turning bar. In accordance with a simple embodiment of the present invention, the bolt is pivotable around an axis extending vertically with respect to a longitudinal axis of the turning bar.

The closing body, which is provided for the selective closing of a respective group of holes in the jacket of the turning bar, is preferably rotatable between its two positions around the longitudinal axis of the turning bar. In comparison with the axial displaceability of the closing body disclosed in DE 43 11 438 C2, this feature of the present invention permits an increased stroke length of the movement of the closing body. Demands made on the positional accuracy of the holes in the jacket and in the closing body can accordingly be relatively low.

To facilitate a rapid switching of the turning device between the two work positions of the turning bar, it is possible to provide a linear actuating member, in particular a pneumatic cylinder, for accomplishing the pivoting movement of the turning bar.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
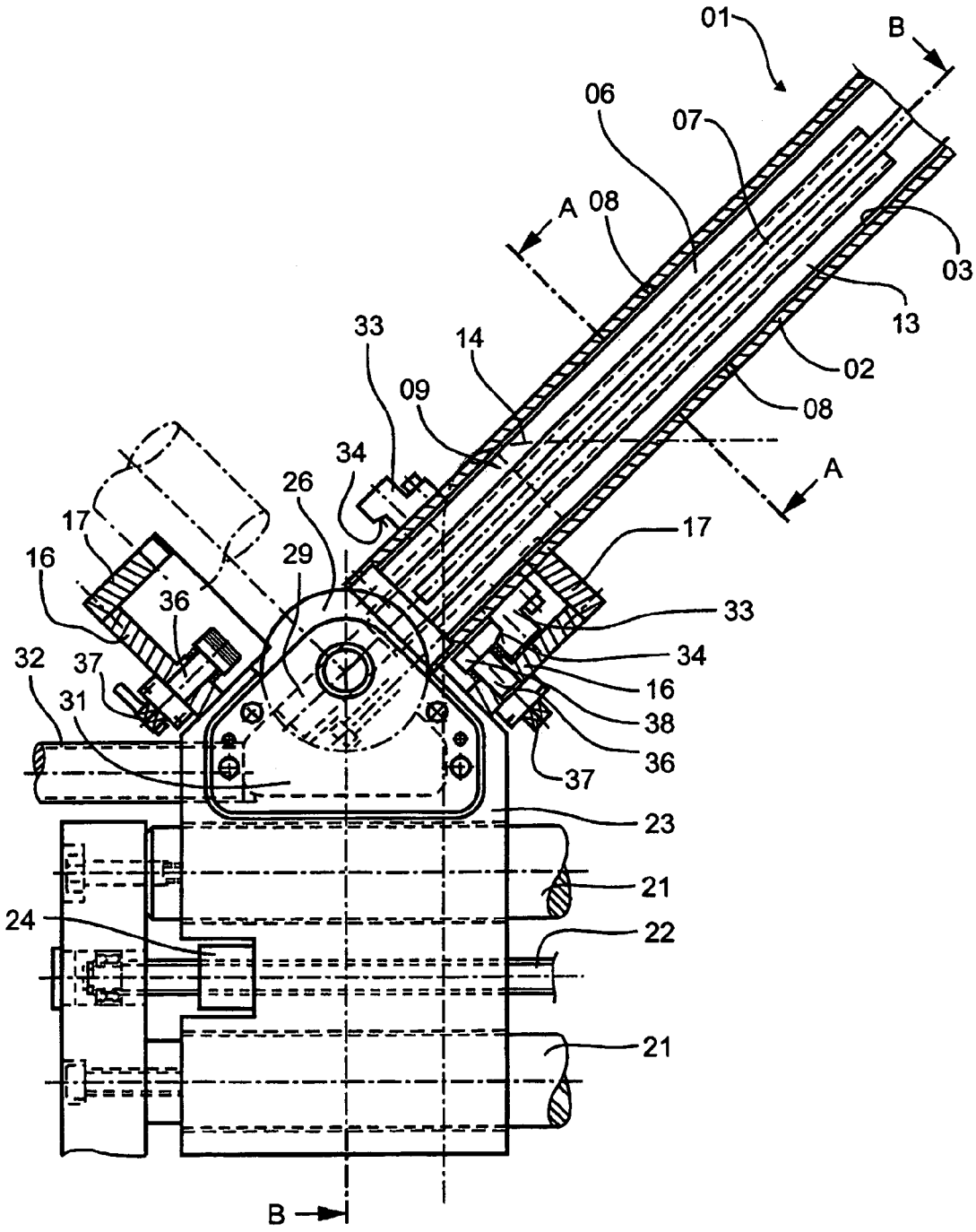
FIG. 1, a top plan view, partially in section, and showing the base area of a turning bar, which is hingedly connected with a rack in accordance with a first preferred embodiment of the present invention, in FIG. 2, a cross-section taken along the line A-A in FIG. 1, in FIG. 3, a top plan view of a free end area of the turning bar, in FIG. 4, a cross-section along the line B-B in FIG. 1, in FIG. 5, a top plan view of a turning bar in accordance with a second preferred embodiment of the present invention, and in FIG. 6, a top plan view of a fixation device in accordance with a third preferred embodiment of the present invention.

In a top plan view, partially in section, FIG. 1 shows a portion of a rack of a turning arrangement, as well as an end area of a turning bar 01 mounted thereon, in accordance with the present invention, which end area of turning bar 01 is called the base area. The rack comprises two support spindles 21, which are seated fixedly and parallel in a frame, which is not specifically represented, and a rack threaded spindle 22 which is rotatably seated between the support spindles 21. A sliding body 23, for example a sliding pad 23, is supported by the support spindles 21 and can be displaced in the longitudinal direction of the support spindles 21 with the aid of a divided or split nut 24, which nut 24 is in engagement with the threaded spindle 22, by turning the threaded spindle 22 in its longitudinal direction.

Figure 4:
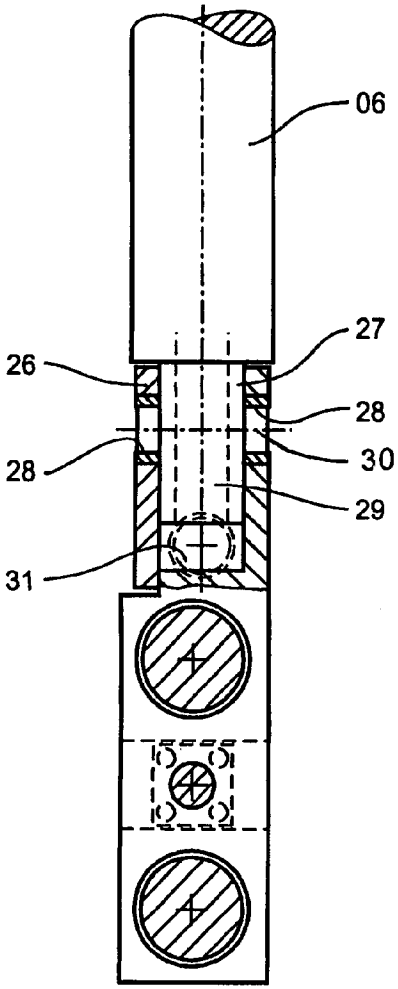

A longitudinal end of a turning bar 01 is connected, via a link 26, with the sliding pad 23. Turning bar 01 is pivotable around a vertical axis, which is perpendicular to the plane of FIG. 1, with a freedom of movement of 90°, between first and second work positions. FIG. 1 shows the turning bar 01 in a first, or "right" work position. The second, or "left" work position is indicated by a dash-dotted contour in FIG. 1. As can be seen in FIG. 4, which is taken along the section line B-B in FIG. 1, the link 26 comprises a flat cylindrical or disk-like body 27, which is securely connected with a first longitudinal end of the turning bar 01 and which flat cylindrical or disk-like body 27 is extended along a link pivot axis 30 in both directions by cylindrical extensions 28 of a narrower diameter than that of the body 27. These extensions 28 are rotatably maintained in a bore of the sliding pad 28.

A link bore 29, which extends in the plane of FIG. 1, is centered in, and passes through the flat cylindrical body 27 of link 26. The link bore 29 connects a chamber 31, which is formed in the sliding pad 23, with a tube section 06 formed in the turning bar 01, which turning bar tube section 06 is extending along the longitudinal axis of the turning bar 01 approximately as far as a longitudinal center of the turning bar 01.

The sliding pad 23 is furthermore provided with a connector 32 for connection of the sliding pad 23 with a compressed air line, so that the interior of the turning bar 01 can be charged with compressed air via the connector 32, the sliding pad chamber 31, the link bore 29 and the turning bar tube section 06.

Figure 2:
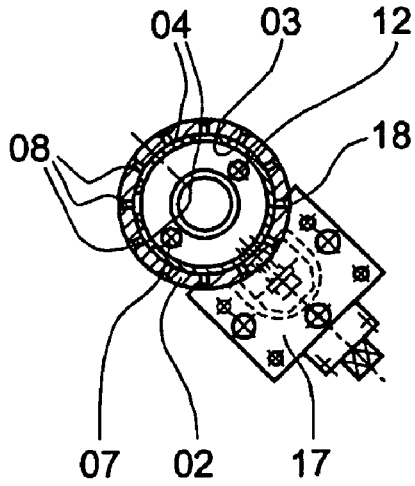

The turning bar 01 has a cylindrical turning bar jacket 02, which jacket 02 is provided with evenly distributed jacket holes 08 over its entire circumference and, except for short pieces at the turning bar longitudinal ends, over its entire axial length. A closing body 03, in the shape of a hollow cylinder 03, rests against an interior wall of the turning bar jacket 02 and is rotatable around the longitudinal axis of the turning bar 01. As can be seen particularly in the sectional view, taken along the line A-A in FIG. 1, and represented in FIG. 2, the closing body 03 is provided with closing body holes 04 over half its circumference. The other half of the circumference of the closing body 03 is imperforate. The holes 04 of the closing body 03 are depicted as being aligned with a first group of holes 08 in the jacket 02, which first group of jacket holes 08 is located on a side of the jacket 02 facing away from the support spindles 21. In FIG. 2 this is the half of the jacket 02 oriented down and to the left. When the turning bar 01 is charged with compressed air, the air exits from this first group of holes 08, and in this way forms an air cushion, on which a web of material which is to be rerouted and which is looped around one half of the circumference of the turning bar 01, can be guided essentially without friction. The remaining holes 08 of the jacket 02, which are located on the circumference of the jacket 02, around which the web of material does not loop, the half oriented up and to the right in FIG. 2, are cut off from the compressed air supply by the imperforate portion of the closing body 03.

In the course of displacing the turning bar 01 from one work position into the other, the closing body 03 preferably performs a rotation through 180°, so that the group of jacket holes 08, which are open in the one work position of the turning bar 01, in the other work position of the turning bar 01 are located opposite the closed half of the circumference of the closing body 03, while the jacket holes 08 of the other group are now aligned with the holes 04 of the closing body 03. Such a coupling of the rotation of the closing body 03 to the displacement of the turning bar 01 can take place, for example, with the aid of a stationary gear ring on the link 26, which gear ring is not specifically represented and which meshes with an exterior teeth arrangement of the closing body 03.

Figure 3:
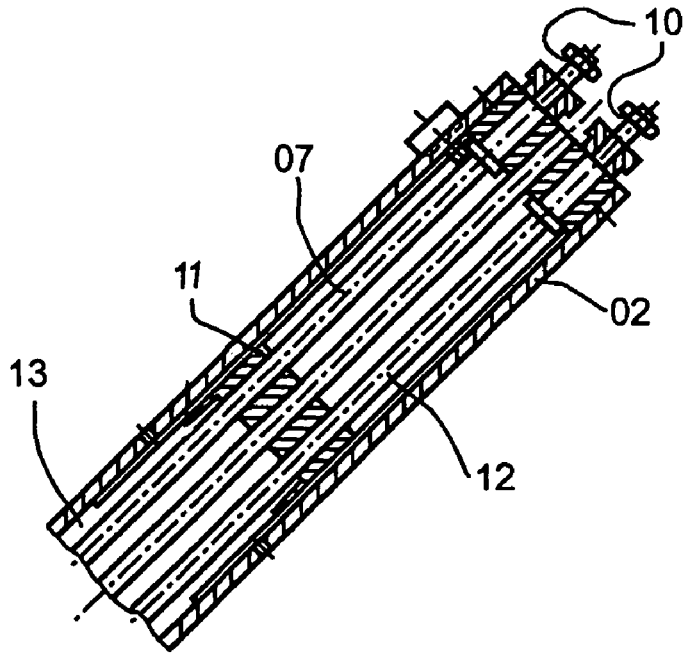

A first turning bar threaded spindle 07, as seen in FIG. 3, extends from the free end of the turning bar 01, and in the interior of the turning bar 01 into the immediate vicinity of the turning bar end represented in FIG. 1, which turning bar end is connected with the link 26. The first threaded spindle 07 is arranged offset to the side of the longitudinal axis of the turning bar 01 and extends outside the tube section 06 and is parallel with the tube section 06. A screw thread of spindle 07 is in engagement with an interior screw thread of a first piston 09, which first piston 09 can be displaced in the axial direction of the turning bar 01 by rotating the first threaded spindle 07. For rotating the threaded spindle 07, an actuating element 10, for example a nut 10, is attached, fixed against relative rotation, to the free end of the first turning bar threaded spindle 07 projecting from the free end of the turning bar 01. Nut 10 is rotatable by a suitable wrench which can be used to turn the first turning bar threaded spindle 07. The lateral faces of the first piston 09 rest tightly against the interior face of the hollow-cylindrical closing body 03.

A corresponding second piston 11, which is axially displaceable with the aid of a second turning bar threaded spindle 12 also supporting a nut 10, is arranged at the free end of the turning bar 01, as represented in FIG. 3. Each of the two pistons 09, 11 constitutes a limit, in the axial direction of the turning bar 01, of the interior 13 of the turning bar 01 to be charged with compressed air via the tube section 06.

The borders of the pistons 09, 11 facing the interior 13 of the turning bar 01 each follow the course of an edge 14 of a web of material that is looped around the turning bar 01, i.e. they essentially follow the course of two helically-shaped sections of opposite handedness, each extending around half the piston circumference.

The sliding pad 23 has two arms 16, which extend at an angle of 90° from each other and on the end of each of which arms 16 a stop 17 has been mounted, which stop 17 has a concave side 18 facing the turning bar 01, as represented in FIG. 2. The two stops 17 limit the pivoting freedom of the turning bar 01 in the link 26 to exactly 90°. For a fine adjustment of the setting positions, or of the pivoting freedom, it is possible to provide an adjusting mechanism for changing the position of the stop 17 parallel in relation to the direction of the line A-A.

The turning bar 01 has protrusions 33, as seen in FIG. 1, on two opposite ends, each of which protrusions 33 has an inclined face 34 facing the jacket 02 of the turning bar 01. A shaft 36, which is rotatably seated in each sliding pad arm 16, has a square extension 37 at an end facing away from the turning bar 01, on which square extension 37 an appropriate wrench, for use in rotating or pivoting the shaft 36, can be placed. On its opposite end facing the turning bar 01, the shaft 36 supports a bolt 38, which bolt 38 is represented on the left arm 16 of the sliding pad 23 and on the right arm 16 of the sliding pad 23, in alternate positions that are pivoted by 90° with respect to each other.

The bolt 38 of the right arm 16 extends behind the inclined face 34 of the protrusion 33 and in this way acts as a lock and keeps the turning bar 01 pressed against the right stop 17. The bolt 38 itself has an inclined face which, in the locked position, is pushed against the inclined face 34 of the protrusion 33. It is achieved, because of the inclined course of these inclined faces 34, that, by pivoting the bolt 38 out of the vertical position represented at the right arm 16, and by pivoting of the bolt 38 into the horizontal position represented at the left arm 16, and with the turning bar 01 being fixed in place against the stop 17, the bolt 38 can already be engaged behind the protrusion 33 before the turning bar 01 rests directly against the stop 17, and that the locking of the turning bar 01 is free of play.

Figure 5:
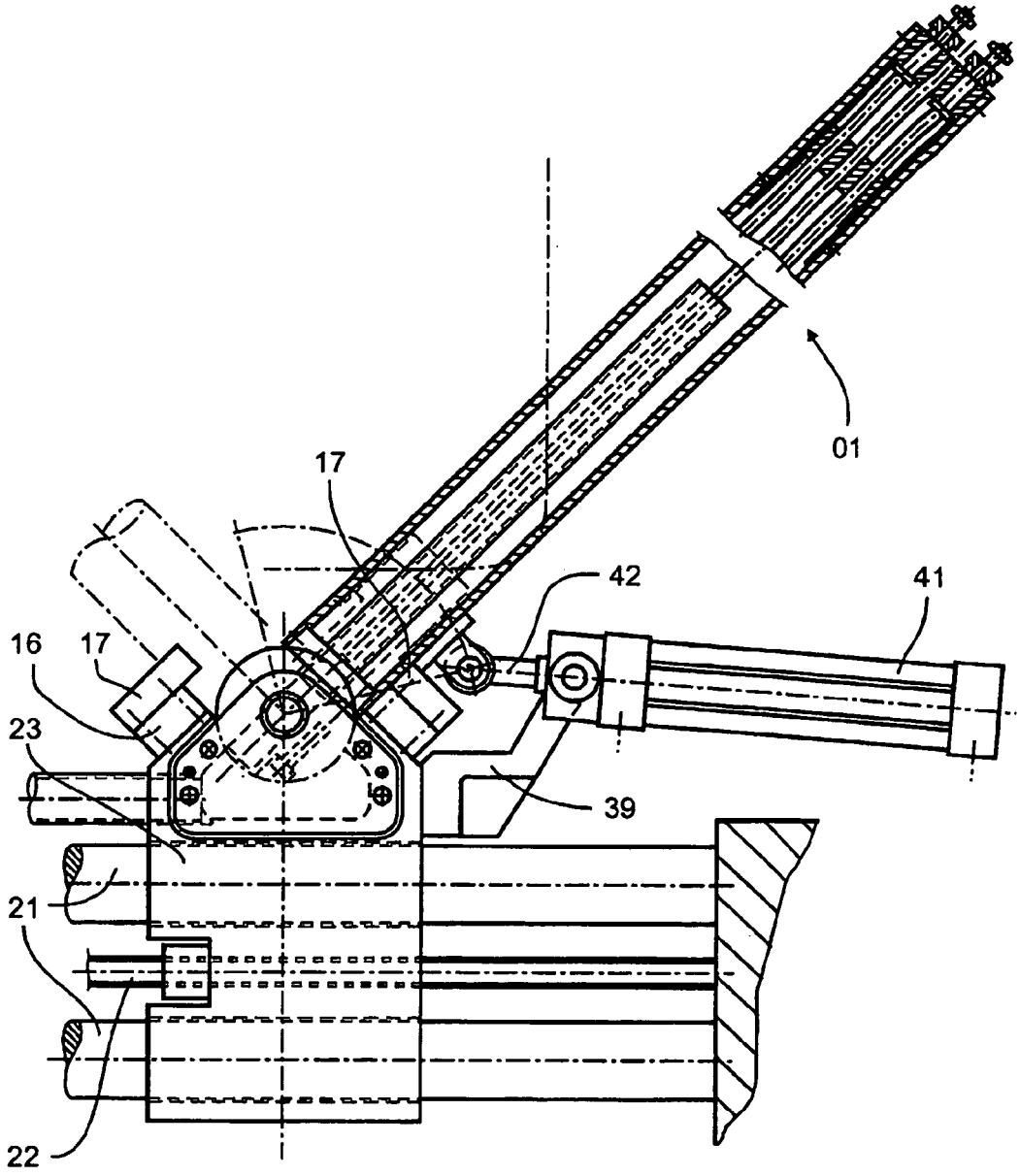

FIG. 5 shows a top plan view of a turning device in accordance with a second preferred embodiment of the present invention. The turning bar 01, represented in this second preferred embodiment in its entirety, the sliding pad 23, as well as the support spindle 21 and the threaded spindle 22, are the same as those described above in connection with FIGS. 1 to 4. The sliding pad 23 also has left and right stops 17 for limiting the pivoting freedom of the turning bar 01. The housing of a linear actuator 41, for example a reciprocally operating pneumatic cylinder 41, is pivotally suspended from a second, actuator support arm 39. The suspension of the cylinder 41 acts on that end of the cylinder 41 at which a piston rod 42 also exits from the housing of the cylinder 41. The piston rod 42, in turn, is hingedly connected with the turning bar 01. The turning bar 01 can be changed between its first and second work positions, against one or the other of the two stops 17, by retracting and extending the piston rod 42. Turning bar 01 can be immovably maintained in one of these first and second work position by arresting the piston rod.

This second preferred embodiment of the turning device in accordance with the present invention permits a remote-controlled switching of the turning bar 01 between its two work positions without direct access of an operator to the turning bar being necessary.

Figure 6:
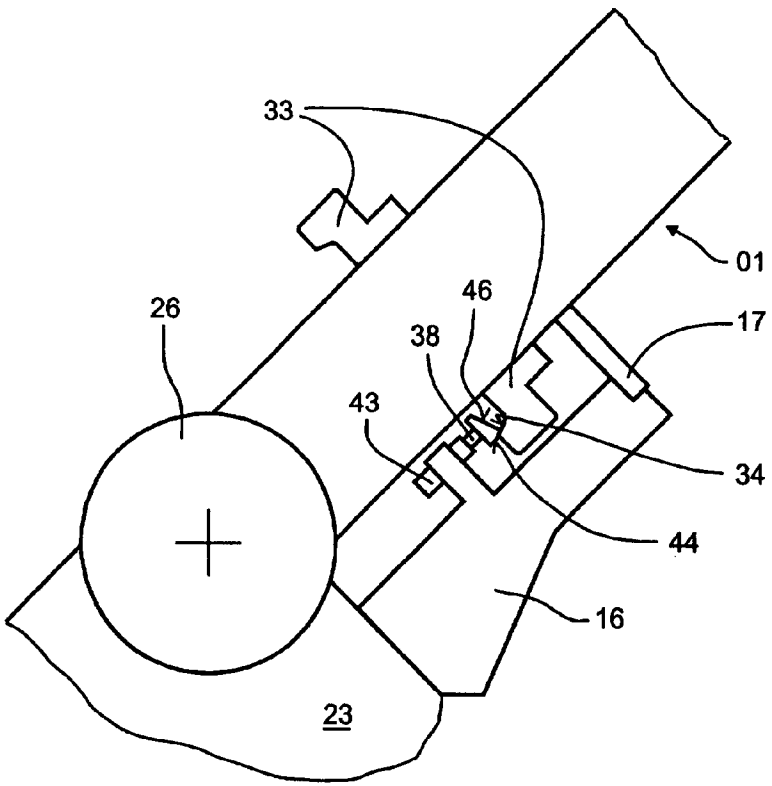

FIG. 6 shows a portion of a turning device in accordance with a third preferred embodiment of the present invention. Again, the turning bar 01, its protrusions 33, the link 26 and the sliding pad 23 are the same as described in connection with FIGS. 1 to 4. Only one sliding pad arm 16 is represented in FIG. 6. A second sliding pad arm 16, which is arranged symmetrically to depicted arm 16 is also provided. In addition to the stop 17, the sliding pad arm 16 supports a linear actuator 43, which linear actuator 43 can be electromagnetically operated or, as in the case in connection with FIG. 5, linear actuator 43 can be a pneumatic cylinder 41. The linear actuator 43 supports a bolt 38, which is displaceable in a direction that is parallel with the longitudinal axis of the turning bar 01. The bolt 38 has first and second inclined faces 44, 46, of which the first inclined face 44 of bolt 38 is oriented parallel with the inclined face 34 of the protrusion 33, and the second inclined face 46 of bolt 38 extends almost perpendicular to, or vertically with respect to the movement direction of the bolt 38. Thus, when the turning bar 01 is moved into the contact position represented in FIG. 6, the protrusion 33 initially encounters the inclined face 46 and slides along it, in the course of which sliding motion the bolt 38 is urged backward against a force exerted by the linear actuator 43. Once the protrusion 33 is past the inclined face 46, the bolt 38 springs forward again and the inclined faces 34, 44 come into contact with each other, so that the turning bar 01 is arrested in the contact position represented in FIG. 6. For pivoting the turning bar 01 into the respectively other position, the linear actuator 43 is triggered in such a way that it retracts the bolt 38 and releases the turning bar 01.

While preferred embodiments of a turning device, in accordance with the present invention, have been set forth fully and completely hereinabove, it will be apparent to one of skill in the art that various changes in, for example, the type of web being turned, the source of supply of the compressed air, the number and size of the jacket holes, and the like could be made without departing from the true spirit and scope of the present invention which is accordingly to be limited only by the appended claims.

What is claimed is:

1. A turning device comprising:

a turning bar adapted to reroute a web of material, said turning bar having a first, longitudinal base end and a second, longitudinal free end spaced from said first longitudinal base end, said turning bar being supported for pivotal movement about a pivot point having a pivot axis adjacent said first longitudinal base end;

a sliding body supported for movement and receiving said first longitudinal base end of said turning bar, said turning bar first longitudinal base end being connected to said sliding body at said pivot point for pivotal movement, with respect to said sliding body, about said pivot axis at said connection of said first longitudinal base end of said turning bar to said sliding body, said second, longitudinal free end of said turning bar being spaced from said sliding body in a cantilever manner; and a linear actuator having a first linear actuator portion pivotably fixed to said sliding body at a first fixed distance from said pivot axis and having a second linear actuator portion pivotably fixed to said turning bar adjacent said first longitudinal base end of said turning bar and spaced at a second fixed distance from said pivot axis, said linear actuator being movable with said sliding body and said turning bar and being operable to pivot said turning bar through 90° about said pivot axis, with respect to said sliding body, to shift said turning bar between first and second web rerouting positions.

2. The turning device of claim 1 further including a jacket on said turning bar; a plurality of holes in said jacket, a turning bar interior, means supplying compressed air to said turning bar interior, and a closing body in said turning bar interior.

3. The turning device of claim 2 further including means for moving said closing body between first and second positions in said turning bar interior, said closing body, in each of said first and second positions closing different sections of said plurality of holes.

4. The turning device of claim 2 wherein said closing body is rotatable about a longitudinal axis of said turning bar between first and second positions.

5. The turning device of claim 1 including a link connecting said turning bar to said sliding body, and a compressed air feed line in said link.

6. The turning device of claim 5 wherein said compressed air feed line passes through said turning bar pivot axis.

7. The turning device of claim 1 wherein said turning bar includes an interior adapted to receive compressed air, and at least one piston in said interior, said piston being axially displaceable in said turning bar and limiting a volume of said interior.

8. The turning device of claim 7 further including a piston actuating element useable to adjust an interior position of said piston, said piston actuating element extending out of said second longitudinal free end of said turning bar.

9. The turning device of claim 7 wherein said closing body is a hollow cylinder and wherein said at least one piston is positioned inside said hollow cylinder.

10. The turning device of claim 7 wherein said at least one piston is associated with said first longitudinal end of said turning bar, and further including a compressed air feed line in said turning bar, said compressed air feed line including a tube section traversing said piston.

11. The turning device of claim 1 further including first and second stops on said sliding body, said first and second stops defining said first and second web rerouting positions of said turning bar.

12. The turning bar of claim 1 wherein said linear actuator is a pneumatic cylinder.

13. A turning device comprising:

a turning bar adapted to reroute a web of material, said turning bar having a first longitudinal base end and a second, longitudinal free end spaced from said first longitudinal base end, said turning bar being supported for pivotal movement about a pivot point having a pivot axis adjacent said first longitudinal base end;

a sliding body supported for movement and receiving said first longitudinal base end of said turning bar, said turning bar first longitudinal base end being connected to said sliding body at said pivot point for pivotal movement, with respect to said sliding body, through 90° about said pivot axis at said connection of said first longitudinal base end of said turning bar to said sliding body, between first and second web rerouting, positions said second, longitudinal free end of said turning bar being spaced from said sliding body in a cantilever manner;

first and second protrusions on said turning bar and adapted to secure said turning bar in a selected one of first and second web rerouting positions, said first and second protrusions extending from diametrically opposite first and second sides of said first longitudinal base end of said turning bar adjacent said pivot axis, each of said first and second protrusions having a protrusion face;

first and second stops on said sliding body and spaced apart from each other on opposite sides of said sliding body and spaced by said pivot axis, said first and second stops cooperating with said first and second protrusions to define said first and second web rerouting positions of said pivotal movement of said turning bar about said pivot axis; and first and second rotatable bolts on said first and second stops, each of said first and second rotatable bolts having a bolt end face being selectively rotatable into positive engagement with a cooperating one of said first and second protrusion faces to secure said turning bar in said selected one of said first and second web rerouting positions and against pivotal movement about said pivot axis toward the other of said first and second web rerouting positions.

14. The turning device of claim 13 further including a jacket on said turning bar; a plurality of holes in said jacket, a turning bar interior, means supplying compressed air to said turning bar interior, and a closing body in said turning bar interior.

15. The turning device of claim 14 further including means for moving said closing body between first and second positions in said turning bar interior, said closing body, in each of said first and second positions closing different sections of said plurality of holes.

16. The turning device of claim 14 wherein said closing body is rotatable about a longitudinal axis of said turning bar between first and second positions.

17. The turning device of claim 13 further including a link connecting said turning bar to said sliding body, and a compressed air feed line in said link.

18. The turning device of claim 17 wherein said compressed air feed line passes through said turning bar pivot axis.

19. The turning device of claim 13 wherein said turning bar includes an interior adapted to receive compressed air, and at least one piston in said interior, said piston being axially displaceable in said turning bar and limiting a volume of said interior.

20. The turning device of claim 19 further including a piston actuating element useable to adjust an interior position of said piston, said piston actuating element extending out of said second longitudinal free end of said turning bar.

21. The turning device of claim 19 wherein said closing body is a hollow cylinder and wherein said at least one piston is positioned inside said hollow cylinder.

22. The turning device of claim 19 wherein said at least one piston is associated with said first longitudinal end of said turning bar, and further including a compressed air feed line in said turning bar, said compressed air feed line including a tube section traversing said piston.

23. The turning device of claim 13 further wherein each said bolt is pivotable about an axis extending perpendicular to a longitudinal axis of said turning bar.

24. The turning device of claim 13 further wherein each said bolt is rotatable about an axis extending perpendicular to a longitudinal axis of said turning bar.

* * * * *